US010299539B2

(12) United States Patent
Finley

(10) Patent No.: US 10,299,539 B2
(45) Date of Patent: May 28, 2019

(54) CONNECTABLE DRAWSTRINGS WITH INSERTION TOOL

(71) Applicant: Steven Douglas Finley, Sherman Oaks, CA (US)

(72) Inventor: Steven Douglas Finley, Sherman Oaks, CA (US)

( * ) Notice: Subject to any disclaimer, the term of this patent is extended or adjusted under 35 U.S.C. 154(b) by 7 days.

(21) Appl. No.: 15/792,746

(22) Filed: Oct. 24, 2017

(65) Prior Publication Data

US 2018/0055148 A1 Mar. 1, 2018

Related U.S. Application Data

(63) Continuation-in-part of application No. 14/667,467, filed on Mar. 24, 2015, now abandoned.

(51) Int. Cl.

| | |
|---|---|
| ***A43C 9/06*** | (2006.01) |
| ***A43C 11/00*** | (2006.01) |
| *A43C 9/04* | (2006.01) |

(52) U.S. Cl.

CPC ..... *A43C 9/06* (2013.01); *A43C 11/008* (2013.01); *A43C 9/04* (2013.01)

(58) Field of Classification Search

CPC .... A43C 1/06; A43C 9/04; A43C 9/06; A43C 7/00; A43C 11/008; A41F 1/00; A41F 9/00; A41F 9/02

USPC ..... D2/978

See application file for complete search history.

(56) References Cited

U.S. PATENT DOCUMENTS 5,353,972 A * 10/1994 Mandel ..... D05B 91/02 223/103
5,447,260 A * 9/1995 Beddow ..... D04D 11/00 223/105
5,524,800 A * 6/1996 Arney ..... A41F 9/025 2/236

(Continued)

OTHER PUBLICATIONS

Hoodlaces®, How to Restring Your Hoodie the Fastest, Dec. 21, 2012, 1 page/video, https://www.youtube.com/watch?v=WF4Es1Y56pA.

*Primary Examiner* — Ismael Izaguirre
(74) *Attorney, Agent, or Firm* — Loza & Loza, LLP; Julio M. Loza

(57) ABSTRACT

Exemplary embodiments are directed to a drawstring for drawing together a material, and a method for making the drawstring. In some aspects, the drawstring includes at least one flexible elongate cord having a first end and a second end, wherein the first end includes a first aglet and the second end includes a second aglet, a first connector having a base end and a top end, the base end including a first cavity for receiving the first aglet, and the top end including a first male fastener, a second connector including a rotating element and a fixed element, the rotating element coupled to the fixed element via a swivel, the rotating element including a first female fastener configured to be removably attached to the first male fastener, and the fixed element having a second cavity for receiving the second aglet, wherein the first aglet is enclosed within the first cavity such that the opening to the first cavity is crimped to prevent removal of the first aglet from the first cavity, and wherein the second aglet is enclosed within the second cavity such that the opening to the second cavity is crimped to prevent removal of the second aglet from the second cavity.

13 Claims, 10 Drawing Sheets

(56) References Cited

U.S. PATENT DOCUMENTS

| | | | | |
|---|---|---|---|---|
| 5,909,833 | A * | 6/1999 | Smith | A45F 3/02<br>224/577 |
| 2008/0229563 | A1* | 9/2008 | Cohen | A43C 9/04<br>24/715.6 |
| 2008/0295305 | A1* | 12/2008 | Hsu | A43C 9/04<br>24/715.6 |
| 2014/0215770 | A1* | 8/2014 | Levesque | A43C 1/06<br>24/303 |

* cited by examiner

CONNECTABLE DRAWSTRINGS WITH INSERTION TOOL

CROSS REFERENCE TO RELATED APPLICATIONS

This application is a continuation-in-part of U.S. patent application Ser. No. 14/667,467 filed on Mar. 24, 2015, which is incorporated herein by reference.

FIELD

This disclosure relates generally to a drawstring, and in particular, a replacement or new product drawstring having threaded connectors, the same threaded connectors configured to be coupled to a removable tool and/or other devices.

BACKGROUND

Modern apparel, for example, swimsuits, warm-ups, children's clothing, etc., often utilize drawstrings that extend through a channel in the garment for the purpose of tightening the garment about the body. However, a damaged drawstring can often present a reassembly problem and can cause additional damage to the garment. The drawstring is also a fashionable accessory to most garments, and a user's preference may result in a desire for frequent changing of the drawstring. Known restringing devices do not provide for efficient and secure attachment of the drawstring to the restringing device and are often inadequate in guiding the cord through the distances required. Thus, there is a need in the art to provide resilient and fashionable drawstrings that can be easily incorporated into an article of clothing.

SUMMARY

The apparatus, devices, and methods of this disclosure each have several aspects, no single one of which is solely responsible for its desirable attributes. Without limiting the scope of this invention as expressed by the claims which follow, some features will now be discussed briefly. After considering this discussion, and particularly after reading the section entitled "Detailed Description" one will understand how the features of this invention provide advantages.

In one aspect, a drawstring for drawing together a material is disclosed. The drawstring includes at least one flexible elongate cord having a first end and a second end, wherein the first end includes a first aglet and the second end includes a second aglet, a first connector having a base end and a top end, the base end including a first cavity for receiving the first aglet, and the top end including a first male fastener, a second connector including a rotating element and a fixed element, the rotating element coupled to the fixed element via a swivel, the rotating element including a first female fastener configured to be removably attached to the first male fastener, and the fixed element having a second cavity for receiving the second aglet, wherein the first aglet is enclosed within the first cavity such that the opening to the first cavity is crimped to prevent removal of the first aglet from the first cavity, and wherein the second aglet is enclosed within the second cavity such that the opening to the second cavity is crimped to prevent removal of the second aglet from the second cavity.

In another aspect, the first connector and the second connector are substantially cylindrical in shape and having a first diameter, the first connector being substantially 25.4 millimeters (25.4 mm) in length, and the second connector being substantially 25.4 millimeters (25.4 mm) in length. In another aspect, the drawstring may further comprising a length of flexible plastic material substantially cylindrical in shape and having the first diameter, the length of flexible plastic material removably coupled to one of the first connector or the second connector. In another aspect, the length of flexible material further comprises a third connector having a second male fastener configured to couple with the first female fastener. In another aspect, the length of flexible material is at least 76.2 millimeters (76.2 mm) in length. In another aspect, the first male fastener is configured to couple with the first female fastener. In another aspect, the drawstring further includes at least one accessory connector, the accessory connector including a substantially cylindrical shape having the first diameter, at least one of a second female fastener or a second male fastener, both the female fastener and the male fastener configured to couple with the corresponding first male fastener or the first female fastener, and a through-hole configured to partially enclose an accessory attachment ring. In another aspect, the the accessory attachment ring is a keyring. In another aspect, the drawstring includes another flexible elongate cord having a third end and a fourth end, wherein the third end includes a third aglet and the fourth end includes a fourth aglet, a third connector having another base end and another top end, the other base end including a second cavity for receiving the third aglet, and the other top end including a third male fastener, a fourth connector including another rotating element and another fixed element, the other rotating element coupled to the other fixed element via a swivel, the other rotating element including a third female fastener, and the other fixed element having a fourth cavity for receiving the fourth aglet, wherein the third aglet is enclosed within the first cavity such that the opening to the first cavity is crimped to prevent removal of the first aglet from the first cavity, and wherein the second aglet is enclosed within the second cavity such that the opening to the second cavity is crimped to prevent removal of the second aglet from the second cavity.

Another aspect disclosed is a method of making a drawstring, including coupling a first connector to a first end of a flexible elongate cord, the first end having a first aglet, wherein the first connector comprises a base end and a top end, the base end including a first cavity for receiving the first aglet, and the top end including a first male fastener, coupling a second connector to a second end of the flexible elongate cord, the second connector including a rotating element and a fixed element, the rotating element coupled to the fixed element via a swivel, the rotating element including a first female fastener, and the fixed element having a second cavity for receiving the second aglet, crimping the opening of the first cavity of the first connector such that the first aglet is enclosed within the first cavity, crimping the opening of the second cavity of the fixed element of the second connector such that the second aglet is enclosed within the second cavity, coupling a length of flexible material to one of the first female fastener or the first male fastener, and coupling an accessory connector to another one of the first female fastener or the first male fastener.

Another aspect disclosed is an apparatus, including a means for drawing together a material having a first end and a second end, a first means for coupling, wherein the first end is enclosed within the first means for coupling, and wherein the first means for coupling is crimped about the first end to facilitate attachment of the first means for coupling to the first end, a second means for coupling, wherein the second end is enclosed within the second means for coupling, and wherein the second means for coupling is crimped about the second end to facilitate attachment of the second means for coupling to the second end, and a means for generating pressure between the first means for coupling and the second means for coupling.

Another aspect disclosed herein is a drawstring replacement, wherein the first aglet includes a diameter sized 75% relative to a diameter of the first cavity, and wherein the second aglet includes a diameter sized 75% relative to a diameter of the second cavity. In yet another aspect, the first aglet includes a diameter sized 80% relative to a diameter of the drawstring, and the second aglet includes the diameter sized 80% relative to the diameter of the drawstring.

Another aspect disclosed herein is a drawstring replacement kit, including a flexible elongate cord having a first end and a second end, wherein the first end includes a first aglet and the second end includes a second aglet, and wherein a first connector is coupled to the first aglet and a second connector is coupled to the second aglet, a first accessory connector comprising a first key ring, a first male fastener, and an o-ring removably attached to the first male fastener, a second accessory connector comprising a second key ring and a second female fastener, and a threading tool comprising a length of flexible plastic and a second male fastener. In one embodiment, the flexible elongate cord may include a plurality fabric portions including a plurality of different colors. In one embodiment, the drawstring replacement kit of claim 13, wherein the threading tool is removably attached to the second accessory connector.

This invention thereby allows for easy replacement of drawstrings configured according to the invention that are present in products, as may be desired for reasons including wear, breakage or fashion statement. Different sizes, types, lengths and colors of drawstrings may be exchanged by this invention, so users will be able to accessorize and customize the products concerned as they see fit.

The invention is not limited to replacing drawstrings. In further accordance with the present invention, two or more drawstrings may be attached in series, end to end, using the connectors. This allows a user to connect drawstrings to vary the length of the overall drawstring and to combine different colors or styles of drawstrings. When worn on apparel having a drawstring and drawstring channel such as a hoodie, for instance, different styles of drawstrings may appear from each end of the drawstring channel, with the connector being hidden inside the channel.

DETAILED DESCRIPTION

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein, one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The word "substantially" is used herein to mean similar to size and shape with respect to at least one dimension.

The present invention facilitates an easy removal and/or replacement of drawstrings from drawstring channels in the products that use them. For the present purposes, a drawstring includes any flexible elongated closure means such laces, ties, strings, elastic cords, pull cords and other like product closure means, as well as corresponding closure ends such as screw fasteners or magnets at either end of the drawstring.

Figure 1:
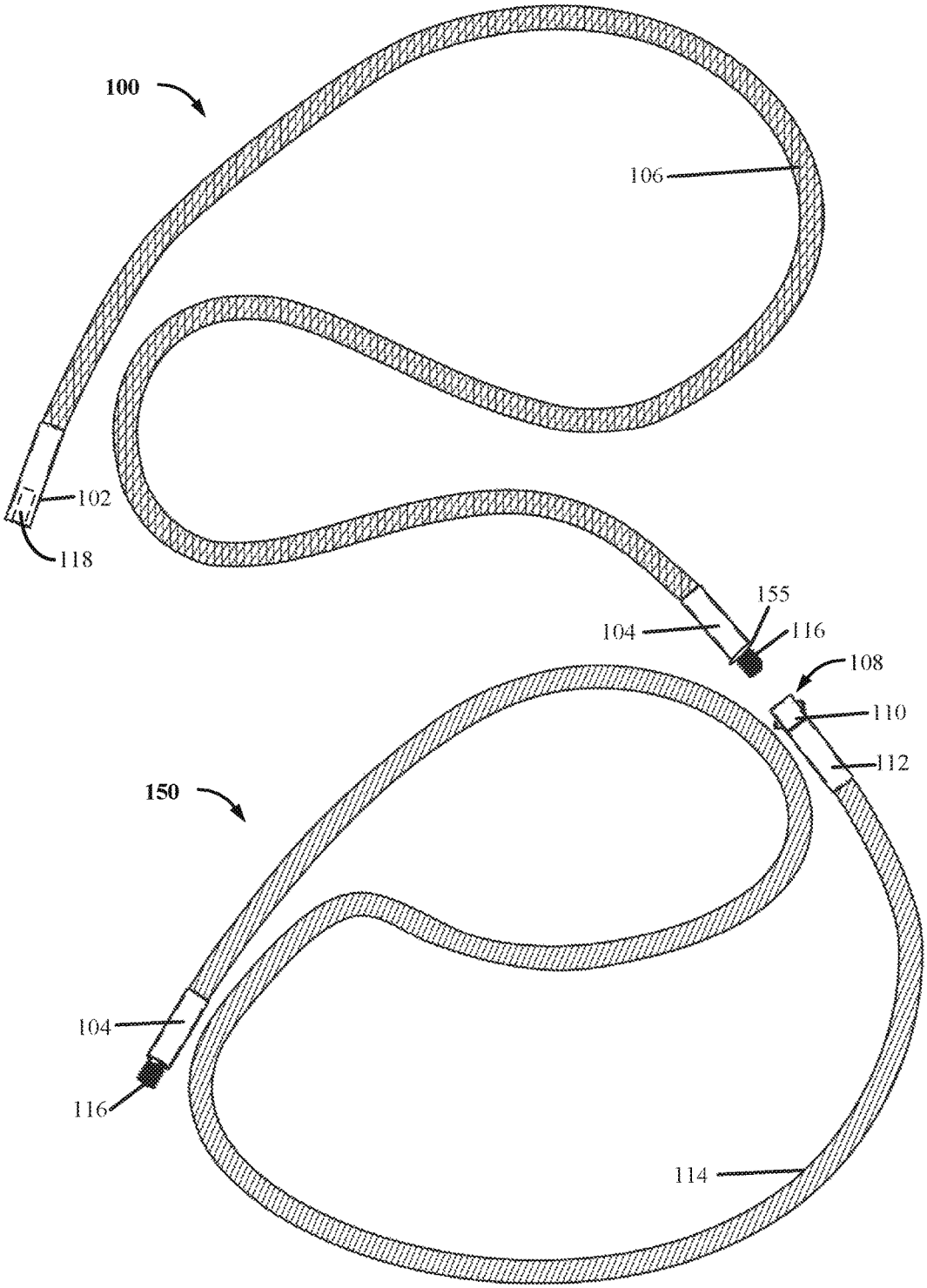
FIG. 1 illustrates a first drawstring and a second drawstring that are disconnected.

FIG. 1 illustrates a first drawstring 100 and a second drawstring 150 that are disconnected. As shown in FIG. 1, in one embodiment, a first drawstring 100 may include a first cord 106 having a female connector 102 coupled to one end of the first cord 106 and having a male connector 104 coupled to another end of the first cord 106. The first cord 106 may be an elongated lace, tie, string, elastic cord, pull cord, or the like, and may be constructed of any appropriate natural and/or synthetic material, having any length. In one example, the first cord 106 is four feet in length.

The female connector 102 may be coupled to one end of the first cord 106 and may be constructed of a plastic or other polymer such as hardened rubber, or a metal. In one embodiment, the female connector 102 may be an aluminum alloy or stainless steel. In one embodiment, the female connector 102 has a cylindrical body having a diameter that is substantially 3.175 millimeters (3.175 mm). This diameter accommodates most conventional through-holes in an article of clothing. It should be appreciated that the cavities may be made in other sizes if needed to accommodate a different sized through-hole. In another embodiment, the cylindrical body diameter is less than or equal to at least one dimension of its corresponding cord. The cylindrical shape of the female connector 102 offers the advantage of being uniform in diameter so that the length of the female connector 102 is substantially the same diameter to allow for easier threading through a garment. For example, such a dimensional characteristic is beneficial because it allows a user to insert the cord into a drawstring channel on a garment that uses a grommet or is otherwise incapable of expanding the size of the channel to receive the connector. The same dimensional characteristics may be applicable to the male connector 104 and the female rotating connector 108. The female connector 102 may also include a first cavity 118 having a diameter appropriate for receiving the male connector 104 at the other end of the first cord 106 or any other cord. The first cavity 118 may be configured as a barrel or torpedo clasp, such that the male connector 104 can couple to the female connector 102. In another embodiment, the first cavity 118 may include a magnet for coupling to the male connector 104. In another embodiment, the male fastener 104 may include a rubber o-ring 155 at the base of the male end fastener 116.

The male connector 104 may be substantially the same diameter and shape as the female connector 102, and may also include a male end fastener 116 configured to couple the male connector 104 to the female connector 102 via the first cavity 118. The male end fastener 116 may include a corresponding end to the barrel or torpedo clasp, and/or corresponding magnet, to the female connector 102 and first cavity 118.

Still referring to FIG. 1, a second drawstring 150 may include a second cord 114 having the male connector 104 coupled to one end of the second cord 114 and having a female rotating connector 108 coupled to another end of the second cord 114. The second cord 114 may include any material or form used by the first cord 106. The female rotating connector 108 may include a rotating element 110 and a fixed element 112. The rotating element 110 is configured such that it can be rotated independently of the rest of the second drawstring 150 components, and it may include a cavity (not shown) similar to that in the female connector 102. The cavity may include a thread pattern so that the rotating element 110 may couple to the corresponding male end fastener 116. In one example, the rotating element 110 provides a benefit of allowing the user to couple one end of the first drawstring to a corresponding end of the second drawstring 150 by spinning the rotating element 110 independently of the rest of the components of the drawstrings. In one embodiment, the male connector 104 may include a rotating element that includes an independently rotatable male end fastener 116 similar to that of the rotating element 110. The second cord 114 may embody another means for drawing together a material having a first end and a second end.

The first cord 106 and/or the second cord 114 may include a pattern or a design. For example, the cords may be constructed of multiple threads of varying colors in a patterned weave. In another example, the cords may include a logo or a name imprinted on the surface of the cord. The cords may be generally circular in shape, or may be substantially flat in one dimension while wide in another dimension. For example, the cords may substantially resemble a rope or a shoelace. In another example, the cords may include a team name or product name in a variety of fonts and colors, and/or may include a color pattern or weave.

Figure 3:
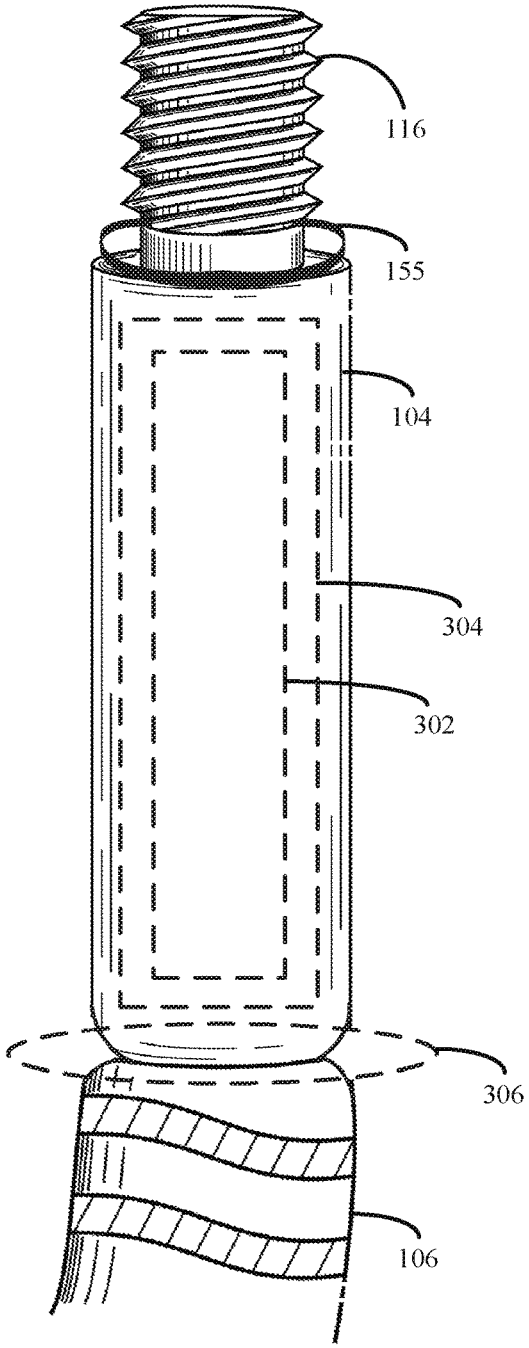
FIG. 3 illustrates a male connector with a male end fastener coupled to the first cord via the aglet.
Figure 4:
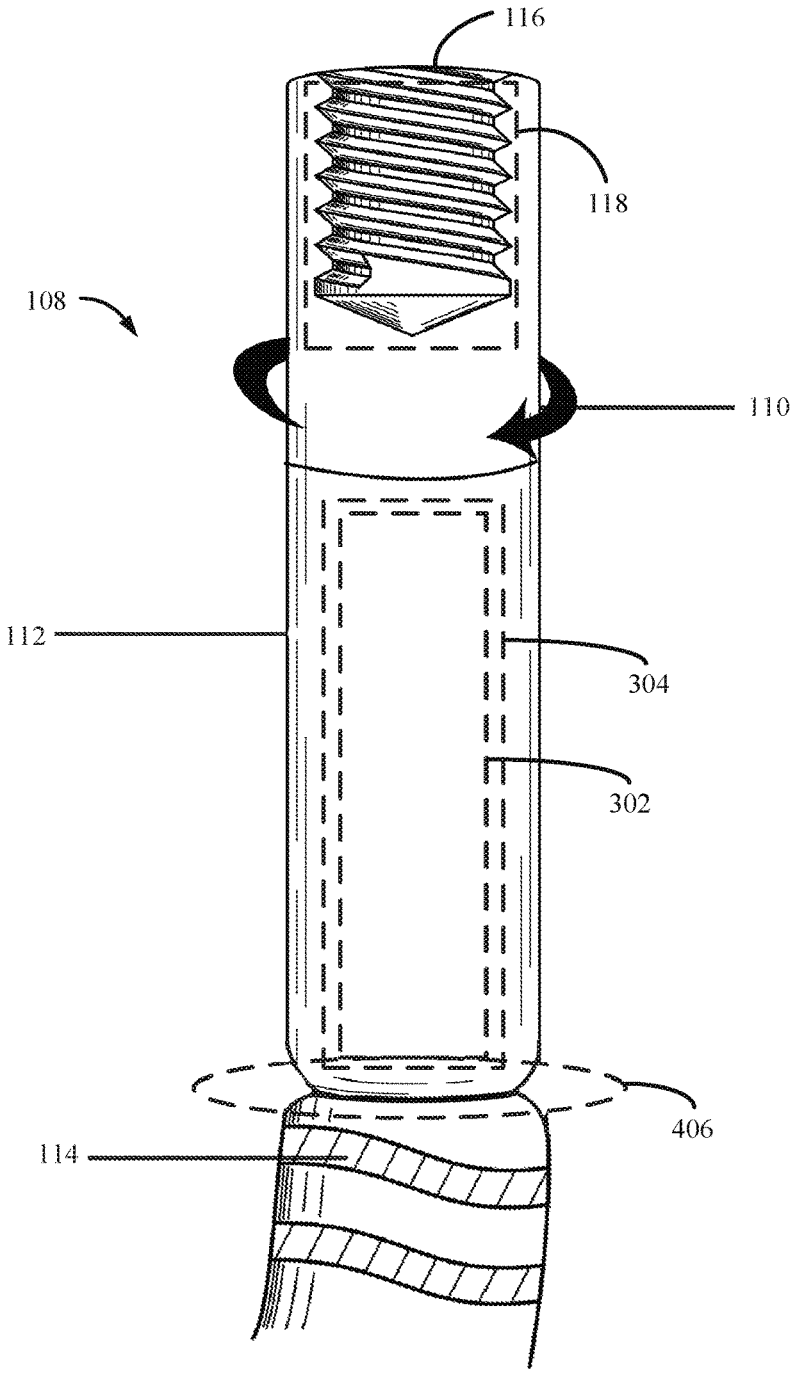
FIG. 4 illustrates the female rotating connector with the threaded first cavity formed in the rotating element and coupled to the second cord via the fixed element.
Figure 5:
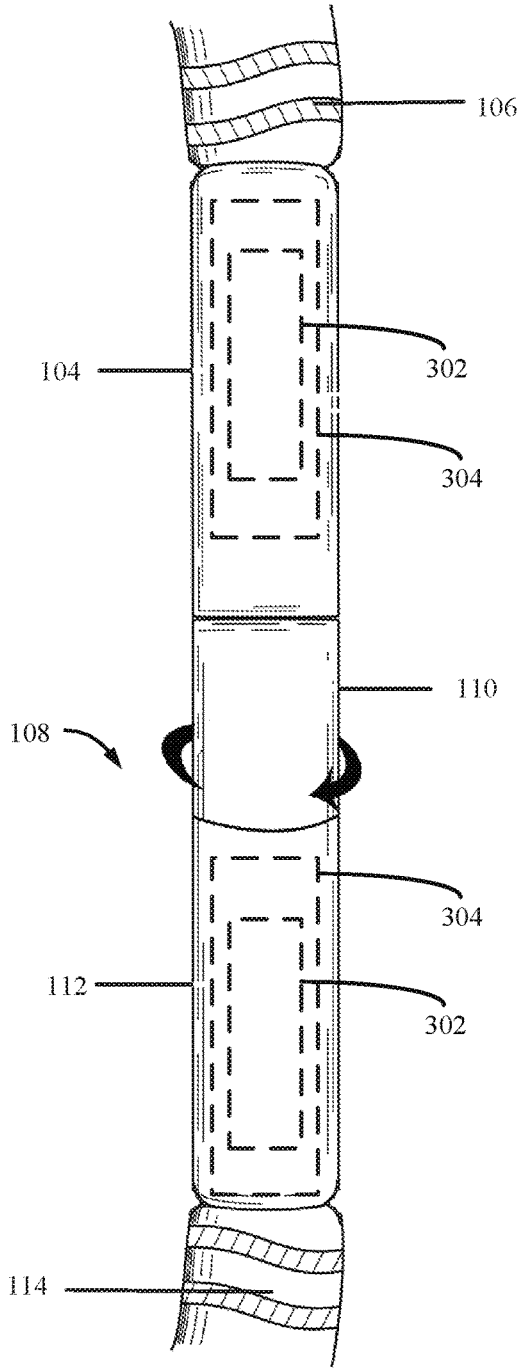
FIG. 5 illustrates one end of the first drawstring coupled to one end of the second drawstring.

The male connector 104, the female connector 104, and the female rotating connector 108 may be coupled to a cord using a crimping means and a cord aglet 302 (see FIGS. 3, 4, and 5). For example, the first cord 106 may include a stopping end, or aglet, at each end of the first cord 106. The portion of the cord having the aglet may be slid into any one of the connectors such that the aglet is enclosed within the connector. One end of the connector can then be crimped such that the crimped end of the connector prevents the aglet from exiting the connector. This provides the benefit of having the aglet at the end of the cord enclosed within the connector so that the connector does not slide off the cord. In this example, the aglet is larger in at least one dimension than the crimped end of the connector. This allows one to push the aglet of the drawstring to the back of the throat of the connector, reducing the side to side shifting of the aglet within the connector. In one embodiment, the aglet may have substantially the same diameter as the cavity of a corresponding connector. In another embodiment, the aglet may be smaller than the cavity of a corresponding connector, for example, a diameter of an aglet may be within a range of 10% to 95% of the diameter of the cavity. In another embodiment, the diameter of the aglet may be larger than the diameter cavity of a corresponding connector. In this example, the aglet may be compressed in order to insert the aglet into the cavity. In one example, the diameter of the aglet may be 10% larger than that of the cavity.

Figure 2:
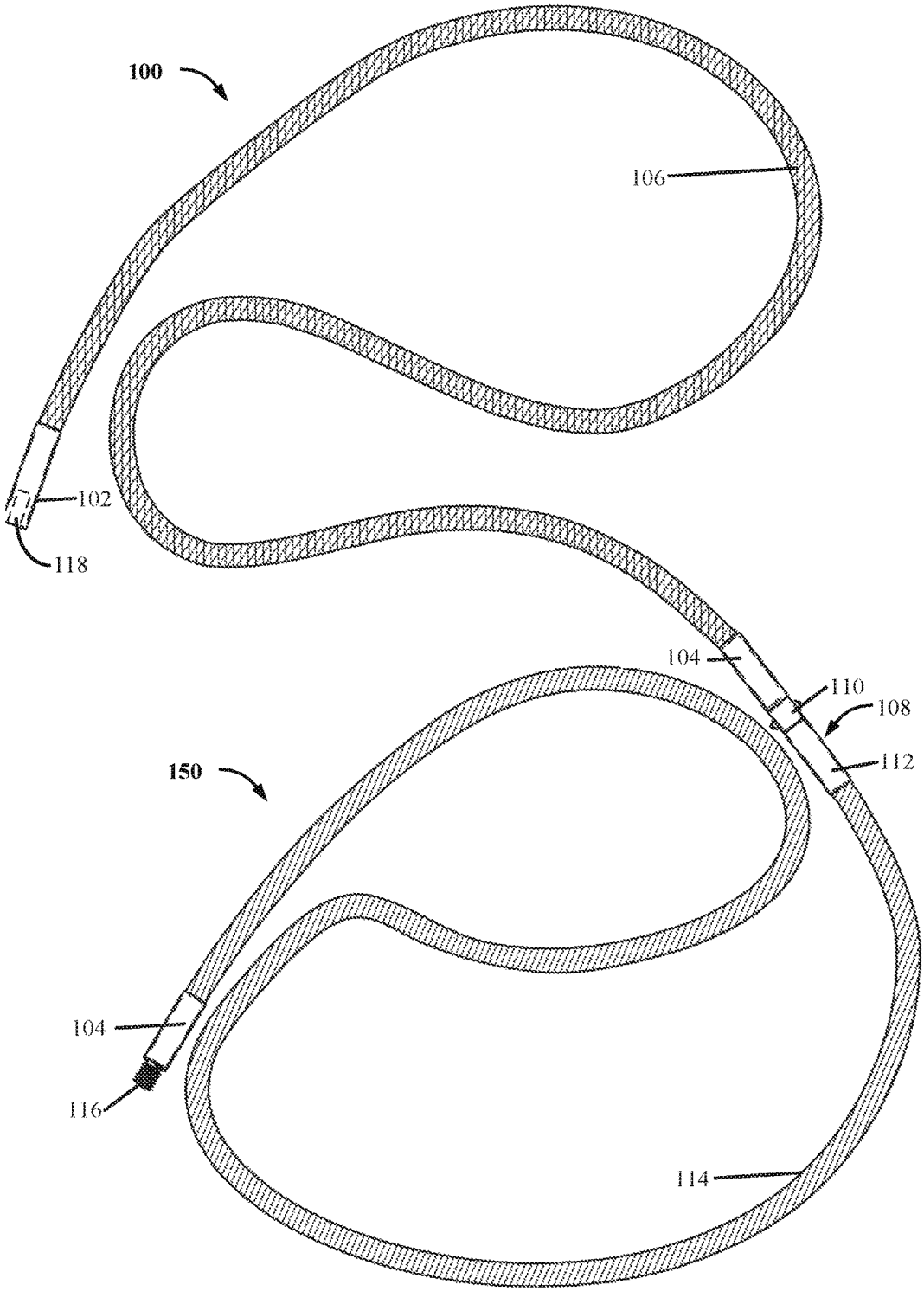
FIG. 2 illustrates the first drawstring and the second drawstring coupled using the male connector of the first drawstring and the female rotating connector of the second drawstring.

FIG. 2 illustrates the first drawstring 100 and the second drawstring 150 coupled using the male connector of the first drawstring 100 and the female rotating connector 108 of the second drawstring. The opposing ends of the coupled drawstrings can be coupled or tied off. In one example, a user may thread one end of the coupled drawstrings through a drawstring channel in a garment.

FIG. 3 illustrates a male connector 104 with a male end fastener 116 coupled to the first cord 106 via the aglet 302. In this example, the first cord is a flexible elongated drawstring. The male end fastener 116 may be on a swivel (not shown) relative to the remaining portion of the male connector 104 and the first cord 106. In this example, the male connector 104 is cylindrical and has an opening at the end opposite to the male end fastener 116. The opening is configured to receive one end of the first cord 106, and may lead to a second cavity 304 in the male connector 104 for enclosing the aglet 302. The portion of the first cord 106 received by the male connector 104 may include the aglet 302 made from a plastic or metal. In one embodiment, the aglet 302 may be substantially the same size as the second cavity 304 such that the aglet 302 is limited in its movement within the second cavity 304. In one example, the second cavity 304 has a slightly larger volume than that of the aglet 302 to facilitate free rotation of the male connector 104 about the aglet 302 and corresponding first cord 106.

The aglet 302 may be substantially the same size as the string. For example, the aglet 302 may have a diameter equal to that of the diameter of the cord (106/114). In another example, the aglet 302 may be smaller than the cord (106/114). For example, the cord may be in a compressed state caused by the aglet 302. As such, a diameter of the aglet may be sized within a range of 10% to 95% relative to the diameter of the cord. In another example, the aglet 302 is larger than the cord (106/114). For example, the aglet 302 may include additional material to increase size, and/or the aglet 302 may compress a larger portion of the cord. In any of these embodiments, the cord may be constructed of a rigid or flexible material. For example, the flexible material may be compressed. For example, the cord may be constructed of a fabric with air gaps. In another example, the cord may be constructed of metal, and relatively less flexible or having no flexibility. In another example, the cord may be constructed of a combination of metal and fabric.

The opening of the male connector at the end opposite to the male end fastener 116 may be crimped or tapered to enclose the aglet 302 and prevent the first cord 106 from being removed from the connector. The male end fastener 116 of the male connector 104 may include a threaded section configured for screw-attachment to a corresponding threaded first cavity 118 of the female connector 102 or the rotating element 110 of the female rotating connector 108. FIG. 3 further illustrates a region shown with a dashed ellipse indicating a region 306 of the male connector 104 that may be crimped down around the first cord 106 to enclose the aglet 302 within the second cavity 304. The male connector 104 may embody a means for coupling.

Still referring to FIG. 3, the male end fastener 116 of the male connector 104 may include a rubber washer or o-ring 155 to facilitate a pressure connection between the male connector 104, the female connector 102 or the rotating element 110, and/or an accessory device (800, 900) when coupled. Such an embodiment provides the advantage of a pressure connection between the connectors, so that the connections do not become loose or disconnected when the user is running, washing the clothing, or engaging in any activity that might cause enough vibration to compromise the connections. The o-ring 155 provides a more robust connection than a metal-to-metal connection. Alternatively, the o-ring 155 may be a plastic or fabric material. The o-ring may embody a means for generating pressure between the first means for coupling and the second means for coupling.

FIG. 4 illustrates the female rotating connector 108 with the threaded first cavity 118 formed in the rotating element 110 and coupled to the second cord 114 via the fixed element 112. The threaded first cavity 118 may be configured to receive the male end fastener 116 to couple one or more cords via corresponding ends. The rotating element 110 and the fixed element 112 may be coupled using a swivel such that the rotating element 110 and the fixed element 112 can rotate independent of each other. The swivel may allow full rotation of the rotating element 110 relative to the fixed element. This configuration allows the user to couple other connectors and/or cords to the female rotating connector 108 without bunching up the attached cord, or causing the cord to also rotate.

The female rotating connector 108 may be coupled to a cord in the same manner as the male connector 104. For example, the female rotating connector 108 is cylindrical and has an opening at the base of the fixed element 112. The opening is configured to receive one end of the second cord 114, and may lead to a second cavity 304 in the fixed element 112 for enclosing the aglet 302. The portion of the second cord 114 received by the fixed element may include the aglet 302 made from a plastic or metal. In one embodiment, the aglet 302 may be substantially the same size as the second cavity 304 such that the aglet 302 is limited in its movement within the second cavity 304. In one example, the second cavity 304 has a slightly larger volume than that of the aglet 302 to facilitate free rotation of the fixed element 112 about the aglet 302 and corresponding second cord 114. The opening of the fixed element 112 at the end opposite to the threaded first cavity 118 may be crimped or tapered to enclose the aglet 302 within the second cavity 304 and prevent the second cord 114 from being removed from the connector. FIG. 4 further illustrates a region 406 shown with a dashed ellipse indicating a region of the female rotating connector 108 that may be crimped down around the second cord 114 to enclose the aglet 302 within the second cavity 304. The female rotating connector 108 may embody another means for coupling.

FIG. 5 illustrates one end of the first drawstring 100 coupled to one end of the second drawstring 150. In this example, the threaded first cavity 118 of the rotating element 110 may receive the male end fastener 116 of the male connector 104. In one embodiment, the rotating element 110 receives and releases the male end fastener 116 by turning the rotating element 110 independently of the fixed element 112, and the male end fastener 116 and male connector 104.

Figure 6:
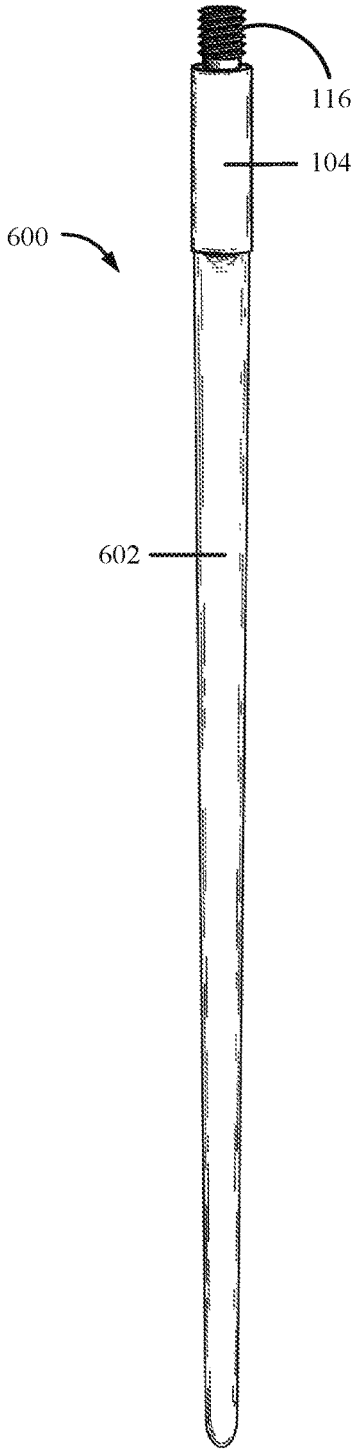
FIG. 6 illustrates a threading tool according to one embodiment.

FIG. 6 illustrates a threading tool 600 according to one embodiment. In this example, the threading tool 600 includes a male end fastener 116 coupled to a male connector 104, and a threading element 602 coupled to the male connector 104 opposite to the male end fastener 116. The threading element 602 may include an elongated, rigid or semi-rigid tube, rod, or wire, suitable for manipulation by a user for threading the first drawstring 100 and/or the second drawstring 150 through a drawstring channel on a garment, e.g. on a hoodie. In one example, the threading tool 600 may be friction-fit or screwed into the rotating element 110 of the female rotating connector 108, or alternatively, to the threaded cavity 118 of the female connector 102. When the threading tool 600 is attached to one end of a drawstring, the user may thread the drawstring into a garment drawstring channel by inserting the tool into one end of a drawstring channel, and manipulating the threading tool along the channel so as to simultaneously pull the drawstring into and through the channel, until the threading tool and one end of the drawstring exits the channel at the other end. The threading tool 600 may then be detached from the drawstring, and additional drawstrings and/or accessories (see FIG. 8 and FIG. 9) may be attached. The threading tool 600 may include a logo and/or a pattern printed on the surface. For example, the threading tool 600 may include a team name or product name in a variety of fonts and colors. The threading tool may come in a variety of colors and patterns, for example, blue, and/or camouflage.

Figure 7:
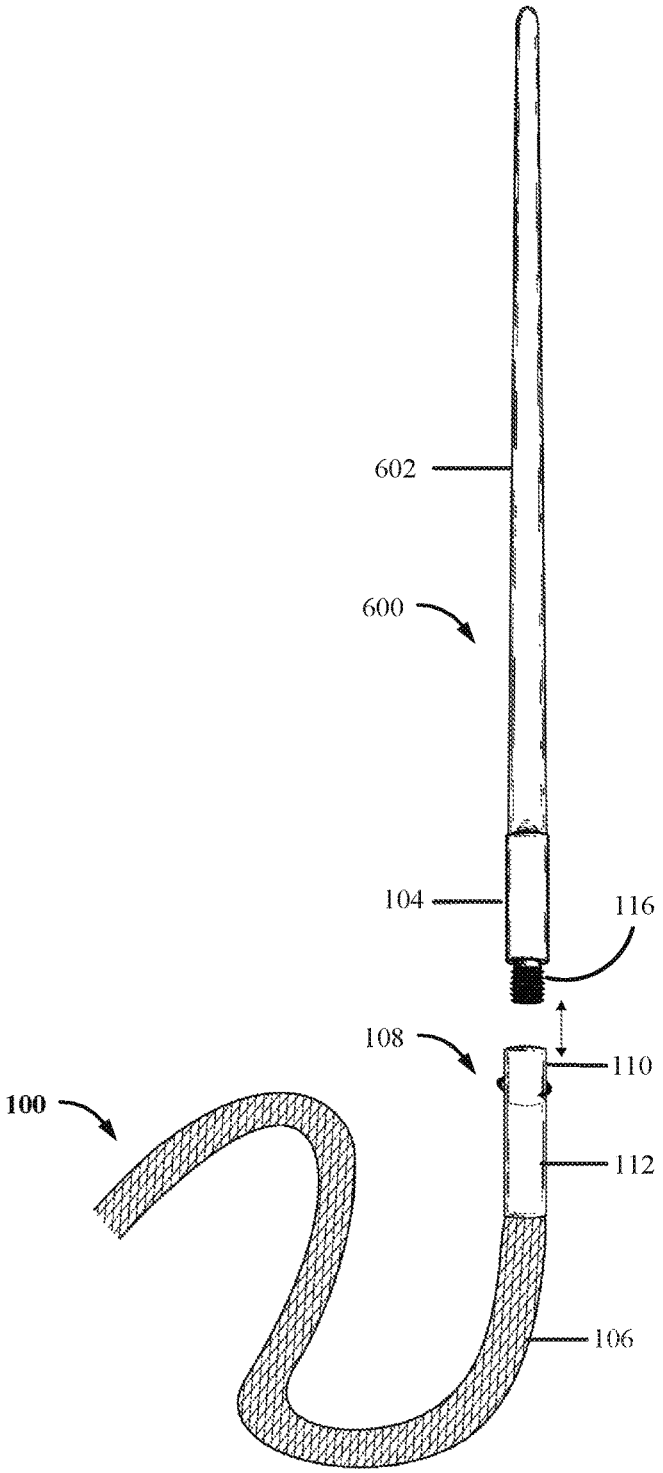
FIG. 7 illustrates an example method of coupling the threading tool to the female rotating connector.

FIG. 7 illustrates an example method of coupling the threading tool 600 to the female rotating connector 108. In this example, the male connector 104 is coupled to the female rotating connector 108 via the respective male end fastener 116 and rotating element 110. In this example, the threading tool is removably attached to the first drawstring 100 so that the drawstring can be easily threaded through a garment or material. In this example, the female rotating connector 108 is substantially the same size as the first cord 106. The advantage here is that the female rotating connector 108 is able to fit through any hole or opening that can accommodate the cord. The first cord 106 may embody a means for drawing together a material having a first end and a second end.

The user can insert the threading tool 600 into a hole or opening and can feed the threading tool 600 through a channel or course to another opening, through which the user can pull the threading tool and the first drawstring 100. In one example, the channel or course may be enclosed in a material such that the first drawstring 100 and threading tool 600 are not visible, and the course may be longer than the length of the first drawstring 100. In such an example, the second drawstring 150 may be attached to the end opposite to the threading tool 600 of the first drawstring 100, and the user may use the threading tool to pull both the first drawstring 100 and the second drawstring 150 through the channel or course.

Figure 8:
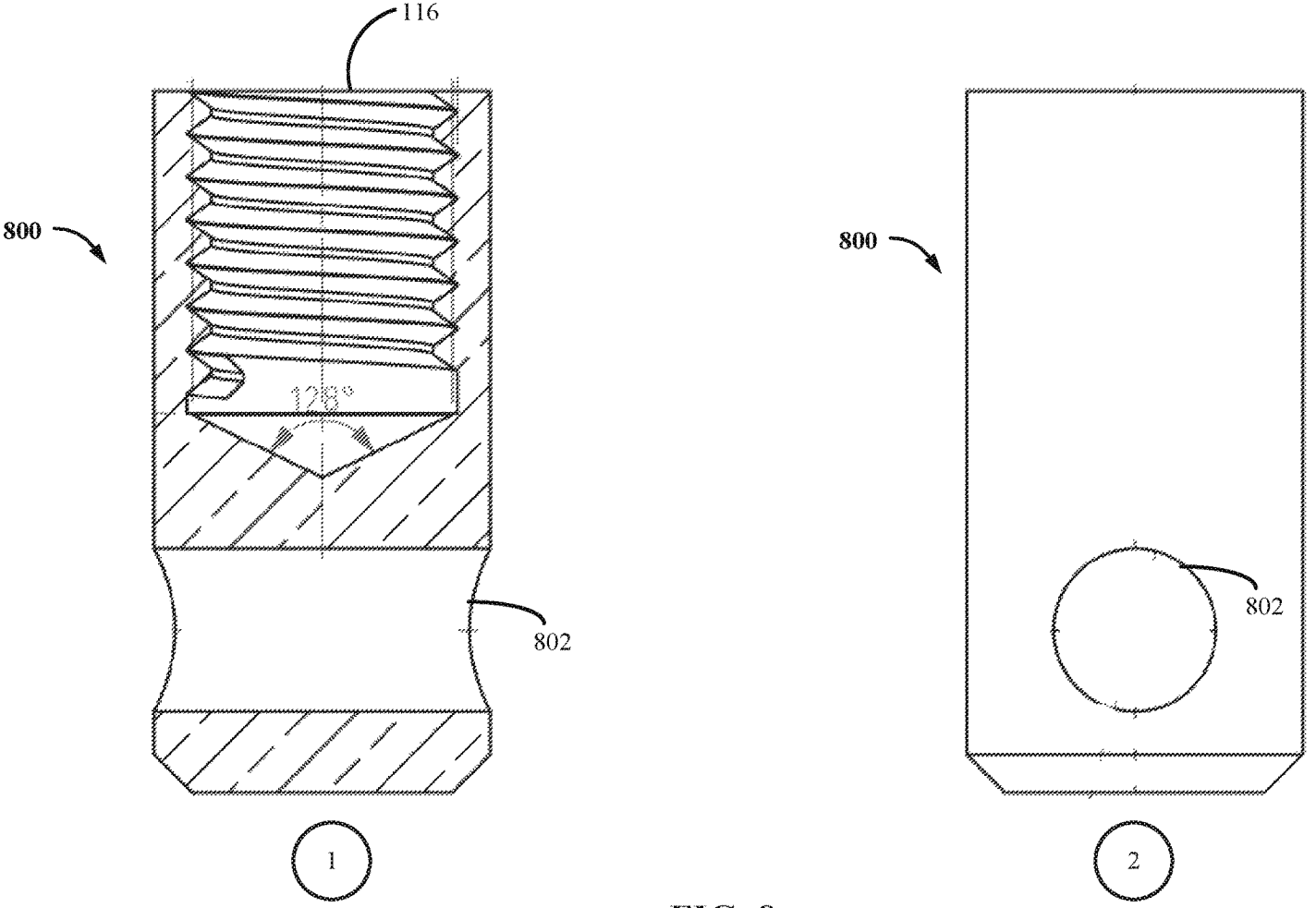
FIG. 8 illustrates two numerically sequenced views of the female accessory connector.

FIG. 8 illustrates two numerically sequenced views of the female accessory connector 800. The first view of FIG. 8 (demarcated numeral 1) is a cross sectional view of the female accessory connector 800. The second view of FIG. 8

(demarcated numeral 2) is a side view of the female accessory connector 800, rotated ninety degrees about a vertical axis relative to the position shown in numeral 1.

The female accessory connector 800 may be constructed of a metal material or plastic, and may be substantially cylindrical in shape. One end of the female accessory connector 800 may include a threaded cavity 118 configured to receive the male end fastener 116 of the threading tool 600 or any of the first drawstring 100 and the second drawstring 150. The female accessory connector 800 may also include a through-hole 802 that can accommodate a key-ring, a clip, or other means of attachment.

Once the user has threaded the drawstring(s) through a garment and/or channel, the user may attach the female accessory connector to at least one end of the threaded drawstring(s) and attach additional accessories to the drawstring(s). For example, the user may attach a key-ring to the female accessory connector 800 via the through-hole 802, and attach a pair of sunglasses to the key-ring.

Figure 9:
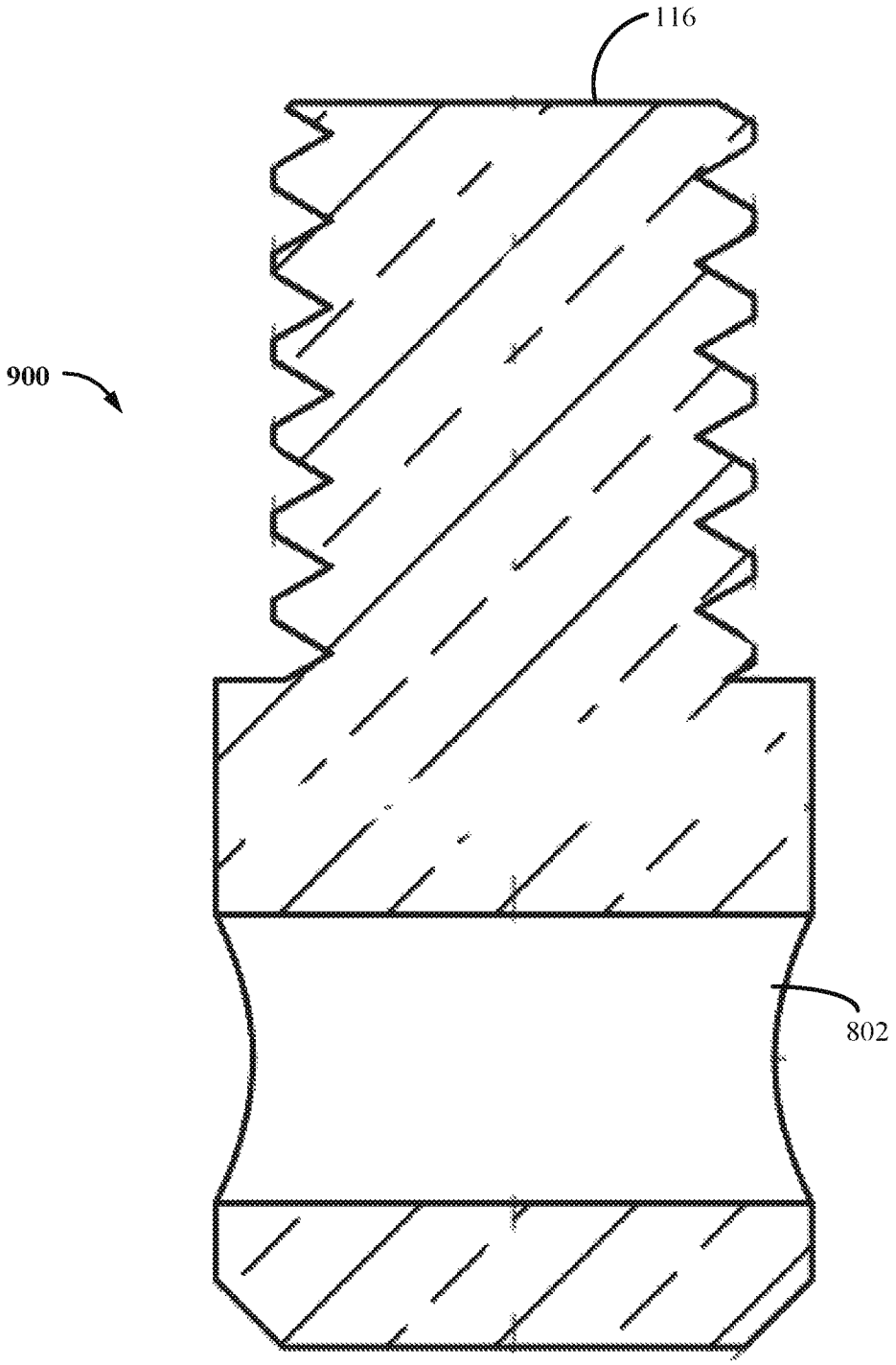
FIG. 9 illustrates a cross sectional view of the male accessory connector.

FIG. 9 illustrates a cross sectional view of the male accessory connector 900. Similar to the female accessory connector 800, the male accessory connector 900 may be constructed of a metal material or plastic, and may be substantially cylindrical in shape. The female accessory connector 800 and the male accessory connector 900 may share substantially similar dimensions. The male accessory connector 900 may include the male end fastener 116, and may be configured to be removably attached to the female connector 102 and/or the female rotating connector 108.

In one configuration, the user may couple the female accessory connector 800 to one end of the drawstring(s) that have been threaded through the garment or material, and couple the male accessory connector 900 to the opposite end of the drawstrings(s), such that each end of the drawstring(s) include an accessory connector. Thus, the male connector 104, the female rotating connector 108, and the female connector 102 are configured for three separate, independent functions depending on the needs of the user: (1) attachment of the first drawstring 100 to the second drawstring 150, (2) attachment of the threading tool to the drawstring for replacing a previously used drawstring and threading the first drawstring 100 and/or second drawstring 150 through a channel (e.g. located within a hoodie), and (3) attachment of accessories. It may be appreciated that the use of male and female connectors on a single drawstring in this embodiment obviates the need for separate couplers to attach ends of the same drawstring or to attach additional drawstrings.

Figure 10:
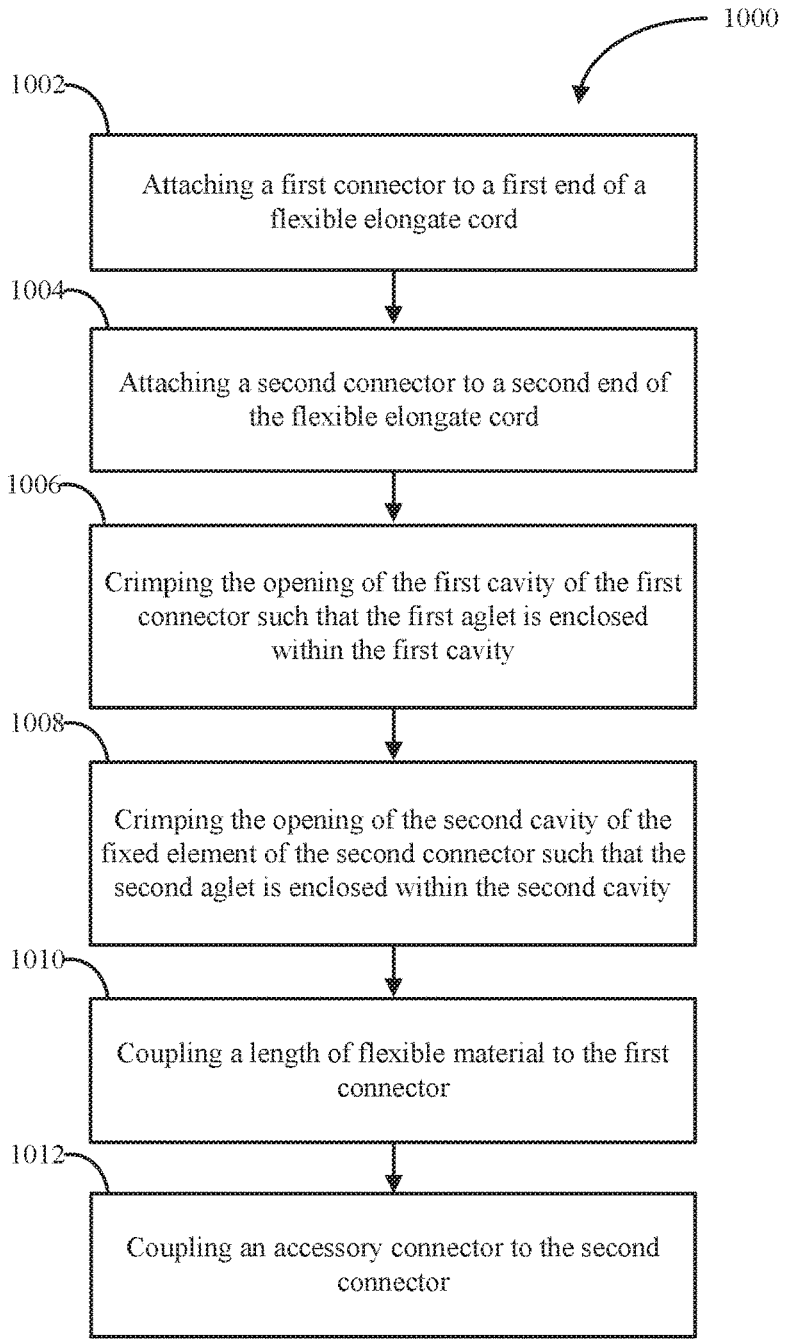
FIG. 10 is a flow chart for illustrating an exemplary process for making a drawstring in accordance with some aspects of the present disclosure

FIG. 10 is a flow chart for illustrating an exemplary process 1000 for making a drawstring in accordance with some aspects of the present disclosure. As described below, some or all illustrated features may be omitted in a particular implementation within the scope of the present disclosure, and some illustrated features may not be required for implementation of all embodiments.

At block 1002, a first connector may be coupled to a first end of a flexible elongate cord. The first connector may include any of the female connector 102, the male connector 104, or the female rotating connector 108. The flexile elongate cord may include any of the first drawstring 100 and the second drawstring. For example, the first connector may be substantially cylindrical in shape, and may include a base end and a top end. The base end may include a first cavity for receiving a first aglet. For example, the first aglet may be coupled to a first end of the flexible elongate cord. The first aglet may comprise any metal or plastic material.

At block 1004, a second connector may be coupled to a second end of the flexible elongate cord. The second connector may include any of the female connector 102, the male connector 104, or the female rotating connector 108. In one embodiment, the second connector include a rotating element 110 and a fixed element 112, wherein the rotating element 110 is coupled to the fixed element 112 via a swivel. In such an arrangement, the rotating element 110 may rotate freely independent of the fixed element 112. In one embodiment, the first connector may include the male connector 104, while the second connector may include the female rotating connector 108. In one example, the second connector may include a second cavity for receiving the second aglet.

At block 1006, the opening of the first cavity of the first connector may be crimped around the flexible elongate cord such that the first aglet is enclosed within the first cavity and the first aglet is prevented from exiting the first cavity.

At block 1008, the opening of the second cavity of the second connector may be crimped around the flexible elongate cord such that the second aglet is enclosed within the second cavity and the second aglet is prevented from exiting the first cavity.

At block 1010 a length of flexible material may be coupled to one of the first connector or the second connector. In one example, the flexible material may include the threading tool 600. For example, the threading tool 600 may be coupled to the first connector using a magnet or a threaded coupling means. Once the threading tool 600 is coupled to the first connector, a user may insert the threading tool 600 into a hole or opening and can feed the threading tool 600 through a channel or course to another opening, through which the user can pull the threading tool and the first drawstring 100. In one example, the channel or course may be enclosed in a material such that the first drawstring 100 and threading tool 600 are not visible, and the course may be longer than the length of the first drawstring 100. In such an example, the second drawstring 150 may be attached to the end opposite to the threading tool 600 of the first drawstring 100. The user may use the threading tool to pull both the first drawstring 100 and the second drawstring 150 through the channel or course.

At block 1012, an accessory connector may be connected to one or more of the first connector and/or the second connector. The accessory connector may include one or both of the female accessory connector 800 and the male accessory connector 900. In one example, the user may couple the female accessory connector 800 to one end of the drawstring (s) that have been threaded through the garment or material, and couple the male accessory connector 900 to the opposite end of the drawstrings(s), such that each end of the drawstring(s) include an accessory connector. Thus, the male connector 104, the female rotating connector 108, and the female connector 102 are configured for three separate, independent functions depending on the needs of the user: (1) attachment of the first drawstring 100 to the second drawstring 150, (2) attachment of the threading tool to the drawstring for replacing a previously used drawstring and threading the first drawstring 100 and/or second drawstring 150 through a channel (e.g. located within a hoodie), and (3) attachment of accessories. It may be appreciated that the use of male and female connectors on a single drawstring in this embodiment obviates the need for separate couplers to attach ends of the same drawstring or to attach additional drawstrings.

One or more of the components, steps, features and/or functions illustrated in FIGS. 1-10 may be rearranged and/or combined into a single component, step, feature or function or embodied in several components, steps, or functions.

Additional elements, components, steps, and/or functions may also be added without departing from novel features disclosed herein. The apparatus, devices, and/or components illustrated in FIGS. 1-10 may be configured to perform one or more of the methods, features, or steps described herein.

It is to be understood that the specific order or hierarchy of steps in the methods disclosed is an illustration of exemplary processes. Based upon design preferences, it is understood that the specific order or hierarchy of steps in the methods may be rearranged. The accompanying method claims present elements of the various steps in a sample order, and are not meant to be limited to the specific order or hierarchy presented unless specifically recited therein.

What is claimed is:

1. A drawstring for drawing together a material, comprising:

at least one flexible elongate cord having a first end and a second end, wherein the first end includes a first aglet and the second end includes a second aglet;

a first connector having a base end and a top end, the base end including a first cavity for receiving the first aglet, and the top end including a first male fastener;

a second connector including a rotating element and a fixed element, the rotating element coupled to the fixed element via a swivel, the rotating element including a first female fastener configured to be removably attached to the first male fastener, and the fixed element having a second cavity for receiving the second aglet, wherein the first connector and the second connector are substantially cylindrical in shape having a first diameter;

a length of flexible plastic material substantially cylindrical in shape having the first diameter, wherein the length of flexible material comprises a third connector having a second male fastener configured to couple with the first female fastener;

an o-ring connected to at least one of the first connector or the second connector, wherein the first aglet is enclosed within the first cavity such that the opening to the first cavity is crimped to prevent removal of the first aglet from the first cavity, and wherein the second aglet is enclosed within the second cavity such that the opening to the second cavity is crimped to prevent removal of the second aglet from the second cavity.

2. The drawstring of claim 1, wherein the first connector is substantially 25.4 millimeters (25.4 mm) in length, and the second connector being is substantially 25.4 millimeters (25.4 mm) in length.

3. The drawstring of claim 1, wherein the length of flexible material is at least 76.2 millimeters (76.2 mm) in length.

4. The drawstring of claim 2, wherein the first male fastener is configured to couple with the first female fastener.

5. The drawstring of claim 2, further comprising at least one accessory connector, the accessory connector comprising:

a substantially cylindrical shape having the first diameter;

at least one of a second female fastener or a second male fastener, both the female fastener and the male fastener configured to couple with the corresponding first male fastener or the first female fastener; and a through-hole configured to partially enclose an accessory attachment ring.

6. The drawstring of claim 5, wherein the accessory attachment ring is a keyring.

7. The drawstring of claim 1, further comprising:

another flexible elongate cord having a third end and a fourth end, wherein the third end includes a third aglet and the fourth end includes a fourth aglet;

a third connector having another base end and another top end, the other base end including a second cavity for receiving the third aglet, and the other top end including a third male fastener;

a fourth connector including another rotating element and another fixed element, the other rotating element coupled to the other fixed element via a swivel, the other rotating element including a third female fastener, and the other fixed element having a fourth cavity for receiving the fourth aglet;

wherein the third aglet is enclosed within the first cavity such that the opening to the first cavity is crimped to prevent removal of the first aglet from the first cavity, and wherein the second aglet is enclosed within the second cavity such that the opening to the second cavity is crimped to prevent removal of the second aglet from the second cavity.

8. The drawstring of claim 1, wherein the first aglet includes a diameter sized 75% relative to a diameter of the first cavity, and wherein the second aglet includes a diameter sized 75% relative to a diameter of the second cavity.

9. The drawstring of claim 1, wherein the first aglet includes a diameter sized 80% relative to a diameter of the drawstring, and wherein the second aglet includes the diameter sized 80% relative to the diameter of the drawstring.

10. A method of making a drawstring, comprising:

coupling a first connector to a first end of a flexible elongate cord, the first end having a first aglet, wherein the first connector comprises a base end and a top end, the base end including a first cavity for receiving the first aglet, and the top end including a first male fastener;

coupling a second connector to a second end of the flexible elongate cord, the second connector including a rotating element and a fixed element, the rotating element coupled to the fixed element via a swivel, the rotating element including a first female fastener, and the fixed element having a second cavity for receiving the second aglet;

crimping the opening of the first cavity of the first connector such that the first aglet is enclosed within the first cavity;

crimping the opening of the second cavity of the fixed element of the second connector such that the second aglet is enclosed within the second cavity;

coupling a length of flexible material to one of the first female fastener or the first male fastener; and coupling an accessory connector to another one of the first female fastener or the first male fastener.

11. A drawstring replacement kit, comprising:

a flexible elongate cord having a first end and a second end, wherein the first end includes a first aglet and the second end includes a second aglet, and wherein a first connector is coupled to the first aglet and a second connector is coupled to the second aglet;

a first accessory connector comprising a first key ring, a first male fastener, and an o-ring removably attached to the first male fastener;

a second accessory connector comprising a second key ring and a second female fastener; and a threading tool comprising a length of flexible plastic and a second male fastener.

12. The drawstring replacement kit of claim 11, wherein the threading tool is removably attached to the second accessory connector.

13. The drawstring replacement kit of claim 11, wherein the flexible elongate cord comprises a plurality fabric portions including a plurality of different colors.

* * * * *